US009561428B2

(12) United States Patent
Antonopoulos

(10) Patent No.: US 9,561,428 B2
(45) Date of Patent: Feb. 7, 2017

(54) HANGMAN TYPE OF LOTTERY GAME

(75) Inventor: Constantinos Antonopoulos, Athens (GR)

(73) Assignee: Intralot International Limited

( * ) Notice: Subject to any disclaimer, the term of this patent is extended or adjusted under 35 U.S.C. 154(b) by 719 days.

(21) Appl. No.: 13/275,519

(22) Filed: Oct. 18, 2011

(65) Prior Publication Data

US 2012/0135794 A1 May 31, 2012

Related U.S. Application Data

(60) Provisional application No. 61/417,914, filed on Nov. 30, 2010.

(51) Int. Cl.

| | |
|---|---|
| ***A63F 3/06*** | (2006.01) |
| *G07C 15/00* | (2006.01) |
| *G07F 17/32* | (2006.01) |
| *A63F 3/00* | (2006.01) |
| *A63F 9/06* | (2006.01) |
| *A63F 9/24* | (2006.01) |

(52) U.S. Cl.

CPC ..... *A63F 3/0605* (2013.01); *A63F 3/00097* (2013.01); *A63F 3/065* (2013.01); *A63F 3/068* (2013.01); *A63F 2009/0659* (2013.01); *A63F 2009/2402* (2013.01); *G07C 15/005* (2013.01); *G07F 17/329* (2013.01); *Y10S 283/903* (2013.01)

(58) Field of Classification Search

USPC ..... 463/17; 273/272

See application file for complete search history.

(56) References Cited

U.S. PATENT DOCUMENTS 5,282,620 A 2/1994 Keesee
5,613,679 A * 3/1997 Casa et al. ..... 273/138.1
(Continued)

FOREIGN PATENT DOCUMENTS

WO WO 9852660 A1 * 11/1998 ..... A63F 3/06

OTHER PUBLICATIONS

International Searching Authority, The International Search Report and the Written Opinion of the International Searching Authority, or the Declaration, PCT/US2011/062371, Mar. 26, 2012, 9 pgs.
(Continued)

*Primary Examiner* — J. Liddle
(74) *Attorney, Agent, or Firm* — Wood Herron & Evans LLP

(57) ABSTRACT

A method of conducting a Hangman type of lottery game includes offering a number of games to play. A number of letter combinations are defined, wherein each of the combinations has at least two letters. A player plays a game by selecting a letter combination or by prompting the lottery game system, by using their mobile electronic device, to randomly select the letter combination having at least two letters. The amount of letters included in the letter combination determines which of the games is played by the player. The selected letter combination is compared with the winning group of letters. A winning mode is defined wherein a predetermined amount of letters in a winning group of letters coincides with the letters included in the selected letter combination. Finally, the player receives a message on the player's mobile device, for example, whether the selected letter combination satisfies the winning mode.

17 Claims, 3 Drawing Sheets

(56) References Cited

U.S. PATENT DOCUMENTS

| | | | | |
|---|---|---|---|---|
| 6,312,334 | B1 | 11/2001 | Yoseloff | |
| 6,394,899 | B1 | 5/2002 | Walker | |
| 7,404,764 | B2 * | 7/2008 | Bozeman | 463/17 |
| 7,407,437 | B2 * | 8/2008 | Bozeman | 463/17 |
| 7,497,778 | B2 * | 3/2009 | Bozeman | 463/17 |
| 7,601,059 | B2 * | 10/2009 | Bozeman | 463/17 |
| 7,780,518 | B2 | 8/2010 | Yoseloff | |
| 7,819,738 | B2 * | 10/2010 | Bozeman et al. | 463/17 |
| 2005/0059464 | A1 | 3/2005 | Bozeman | |
| 2006/0017224 | A1 * | 1/2006 | Seidman et al. | 273/138.1 |
| 2006/0046825 | A1 * | 3/2006 | Bozeman et al. | 463/17 |
| 2006/0121971 | A1 | 6/2006 | Slomiany et al. | |
| 2008/0293493 | A1 | 11/2008 | Moreno | |
| 2009/0298594 | A1 | 12/2009 | Pueyo et al. | |
| 2010/0035674 | A1 | 2/2010 | Slomiany et al. | |
| 2011/0281629 | A1 * | 11/2011 | Meyer | 463/17 |
| 2011/0281637 | A1 * | 11/2011 | Meyer | 463/22 |

OTHER PUBLICATIONS

International Preliminary Report on Patentability dated Dec. 21, 2012, in co-pending International Patent Application No. PCT/US11/62371 (9 pages).

* cited by examiner

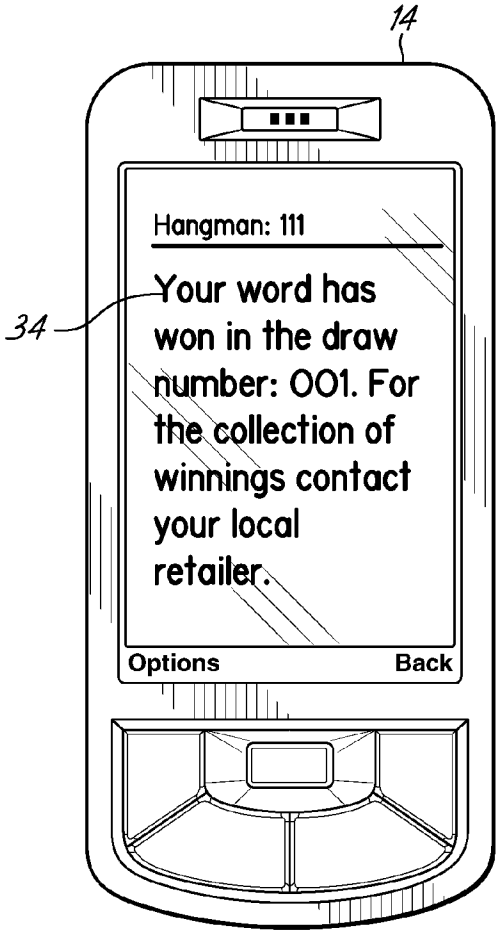
FIG. 3
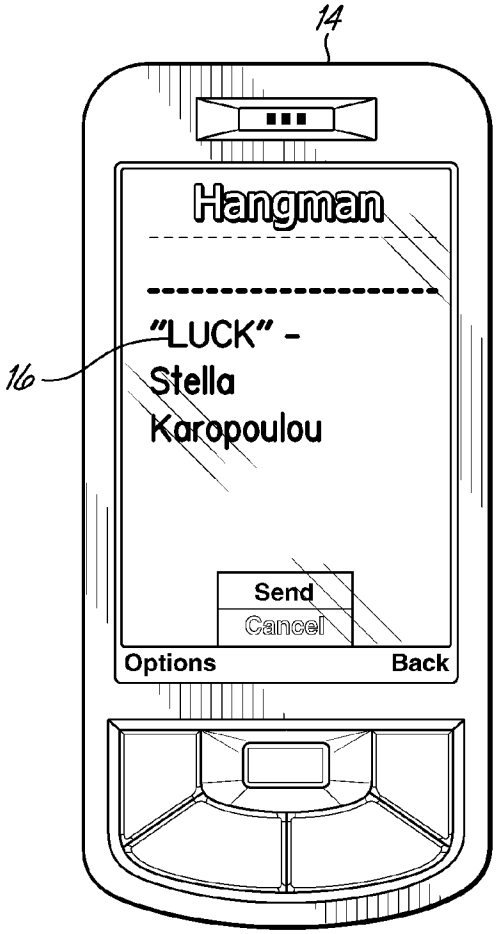
FIG. 2
FIG. 4

HANGMAN TYPE OF LOTTERY GAME

This claims the benefit of U.S. Provisional Application Ser. No. 61/417,914, filed Nov. 30, 2010 and hereby incorporated by reference in its entirety.

BACKGROUND OF THE INVENTION

This invention generally relates to a lottery game, and more particularly, to a lottery game based off of the well known Hangman game.

Known lottery games may have a wager-selection feature wherein a player may select and then change his wager. Moreover, there are lottery games which allow a player to enter into multiple draws with a single lottery ticket purchase. There are also games wherein a user may select an amount of numbers on which to wager, wherein the numbers must match numbers chosen by a gaming device in order to win.

In another aspect, the traditional Hangman game has been enjoyed by many players for years. In the traditional Hangman game, one player selects a word or phrase and presents it to another player with some or all of the letters in the word or phrase displayed as blanks. The second player then guesses letters which are then entered into the appropriate blanks, if applicable. The second player is given a limited number of misses (i.e., letter guesses which are not present in the word/phrase). If the maximum number of misses is reached before the second player deciphers the word/phrase, the first player wins.

There are no lottery games in the prior art which combine all these desirable or similar features along with other unique features to arrive at an interesting and enjoyable lottery experience for the player that reminds one of the popular word-based Hangman game.

SUMMARY OF THE INVENTION

It is an object of this invention to provide a method for playing and conducting a lottery game based on the classic Hangman game. This invention relates to a method for conducting a lottery game which in various embodiments may be played via mobile devices, point-of-sale terminals, lottery tickets and/or computers connected to the internet.

In one aspect of the invention, the game is conducted by offering a number of games to play. A first group of symbols such as the letters in the alphabet is defined, from which a player may select a chosen subset of symbols such as a word. The chosen subset has fewer symbols than the first group of symbols. The game according to one aspect of this invention is played by the player who selects a word of a given length (i.e., a six letter word). Nay information is received from the player. The play information includes the chosen subset of symbols (i.e., the word), the amount of a wager desired by the player and an amount of draws to be played using the subset of symbols such as the word. A random subset of symbols or letters is drawn from the first group of symbols. The randomly drawn symbols or letters thereby define a drawn subset of symbols or letters. The chosen subset and the drawn subset are compared and a winning mode is defined. In the winning mode, the symbols in the chosen subset coincide with a defined portion of the symbols in the drawn subset. In other words, if the drawn letters can be arranged to form the player's word, the player wins. The player may receive a notice on the player's mobile device, for example, whether the chosen subset satisfies the winning mode.

In an alternative aspect, the game is conducted by offering a number of games to play. A number of letter combinations are defined, wherein each of the combinations has at least two letters. A player plays a game by selecting a letter combination or by prompting the lottery game system, by using his or her mobile device, for example, to randomly select a letter combination having at least two letters. The amount of letters included in the letter combination determines which of the games is played by the player. The input of the selected letter combination and the play information is received by the lottery retailer or lottery authority. The play information includes an amount of wager desired by the player and an amount of draws to be played using the selected letter combination. A winning group of letters is drawn from at least one defined pool of letters. The winning group includes at least as many letters as the selected letter combination. The selected letter combination is compared with the winning group of letters. A winning mode is defined wherein a predetermined amount of letters in the winning group coincides with the letters included in the selected letter combination. Finally, the player may receive a message on the player's mobile device, for example, whether the selected letter combination satisfies the winning mode. If the player wins, the player may visit a lottery retailer to claim the winnings.

In this manner, the invention offers an interesting and enjoyable experience for the player reminiscent of the traditional Hangman game with a high frequency of draws, as well as player selections, wagers, draws and multiple games which may be selected by the player on the player's mobile device.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

FIG. 2 is a front planar view of a mobile device wherein a player has input a word to be entered in a lottery game;

FIG. 3 is view similar to FIG. 2 displaying a notification to the player that the word selection has been entered into the drawing;

FIG. 4 is a view similar to FIGS. 2-3 displaying an indication to the player that the word selection has won in the lottery drawing;

DETAILED DESCRIPTION OF THE DRAWINGS

Figure 5:
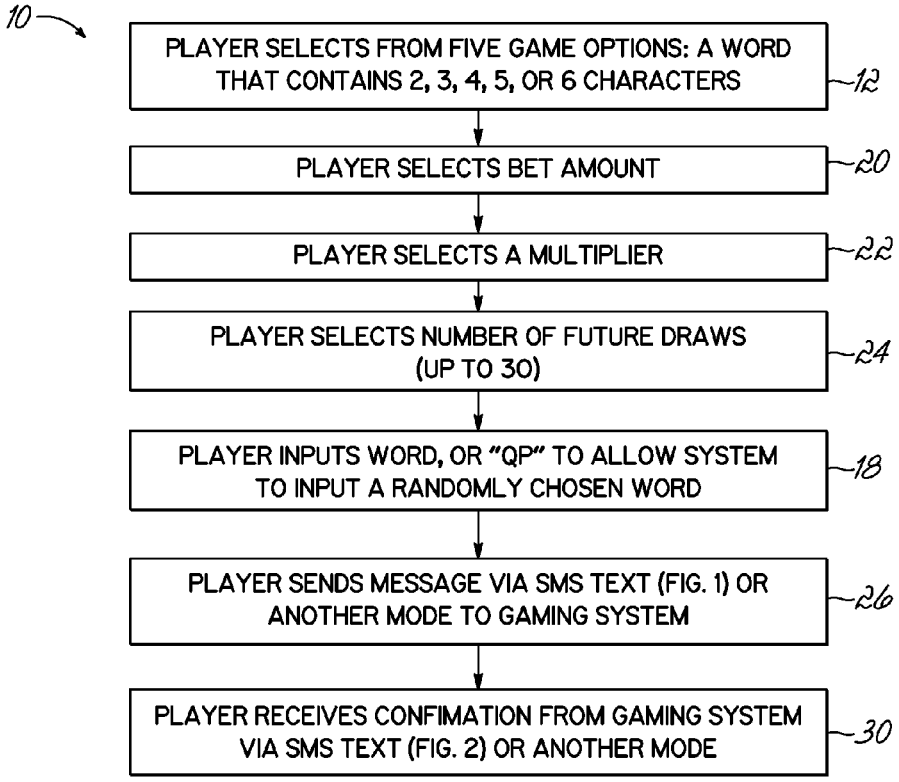
FIG. 5 is a flow chart of the steps according to one embodiment of this invention.

As seen in FIG. 5, one method 10 of conducting a lottery game according to one embodiment of this invention includes a player selecting 12 from multiple game options. The game which is chosen by the player is determined by the amount of symbols, characters or letters chosen by the player. For example, the player may play a first game by selecting two letters, a second game by selecting three letters, and so on. In one embodiment, the player can select up to six characters, and the characters may make-up a word.

For example, as shown in FIG. 2, the player may utilize a mobile electronic device 14, such as a cell phone, smart phone, PDA or the like to select a game requiring four letters 16 as in the example selected word "LUCK" out of a possible twenty-six letter alphabet. In alternative embodiments, however, the player may select up to an amount of letters more or less than six (i.e., ten), thereby possibly decreasing or increasing the difficulty and the odds of winning. Moreover, in alternative embodiments, the letters 16 selected by the player may be random and need not comprise a word. Further, the player, instead of selecting letters 16, may select different symbols or characters, wherein the winning mode may require the symbols or characters to be arranged in some meaningful manner.

Additionally, instead of the player choosing a word, the player may choose an amount of letters 16 and prompt the lottery authority or retailer to randomly generate a word having the player's selected amount of letters. This process of the player choosing an amount of letters and allowing the lottery to randomly generate a word may be referred to in this specification as a "quick pick" option or mode 18 (FIG. 5). To facilitate the "quick pick," in one embodiment, the player selects the amount of letters 16 from the word to consist of and sends it by text message 26 via their mobile device 14, for example, along with an indication that the player desires the system to randomly generate a word. The lottery may then send a confirmation 30 via a text message to the player's phone 14 or another mode. The player indicates his desire for the system to randomly generate a word by sending the letters "QP" following the amount of letters desired to be chosen. It may be possible in other embodiments that facilitation of the "quick pick" occurs in different manners or by different communicative indications.

The player also selects the wager amount 20. A minimum wager amount may be required for each game chosen, which depends on the odds of winning each game. The player is permitted to multiply the minimum wager amount 22 by a "multiplier" in order to increase the wager amount. In one embodiment, the available multipliers are the numbers 2, 3, 4, 5, 6, 8, 10, 12 and 20. The player may also select the amount of consecutive draws 24 in which to enter the selected word or combination of letters or symbols 16. The player's selections are then communicated or transmitted to the lottery authority via a text message, verbally, email message, play slip or other mode 26.

Figure 6:
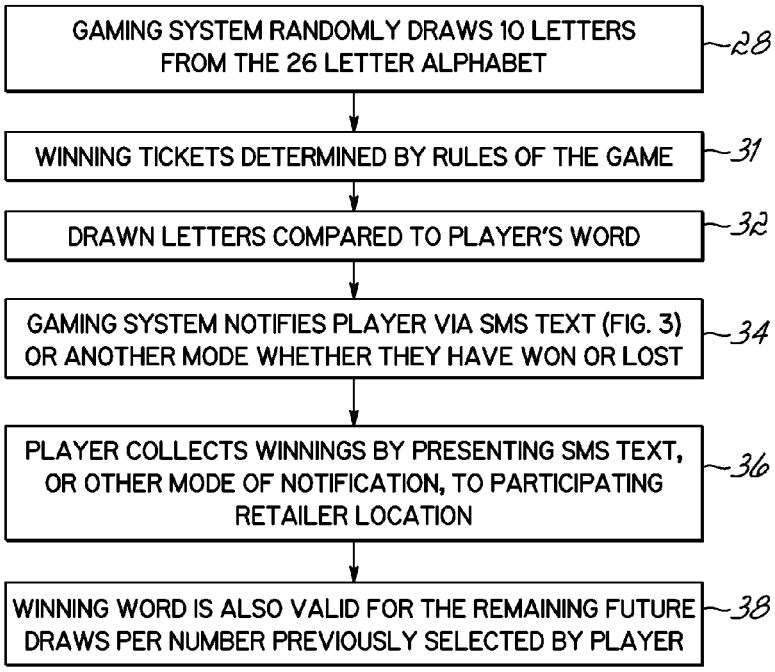
FIG. 6 is a flow chart of the steps according to another aspect of this invention.

As seen in FIG. 6, after receiving the word input from the player, or after randomly generating a "quick pick," the lottery system draws 28 a group of letters or characters from a larger group of letters, such as the entire alphabet, or characters to thereby define a winning group of letters or characters. In one embodiment, the gaming system randomly draws ten letters from the twenty-six letter alphabet, with no letters being placed back into the choosable pool after being chosen. To increase the difficulty of and decrease the odds of winning, each of the ten letters may be chosen from a different set of twenty-six letters of the alphabet. Because the drawn set of letters could contain the same letter multiple times, the rules 31 regarding what letters and words 16 a player can choose could accordingly be changed. For example, in the embodiment where the winning group of letters is chosen from a single twenty-six letter alphabet, a player may not be allowed to select a word that contains any letter more than once, because that would not be a possible draw. On the other hand, if the winning group is chosen from multiple sets of the twenty-six letters of the alphabet, it is possible for a letter to be drawn by the lottery system more than once according to this invention. The words choosable by the player in all embodiments may be defined by, for example, a dictionary in the applicable language.

The lottery system compares 32 the drawn letters, or the "winning group" of letters, as it may be referred to in this specification, to the player's word. To win, the player's selected word or combination of letters, characters or symbols must coincide with at least a defined portion of the randomly generated letters, characters or symbols. In one embodiment, the player's chosen word must coincide with, or match, in any order, all of the randomly generated letters. In the fifth game, an additional winning mode is provided where the player matches five out of the six letters. In alternative embodiments with games utilizing more than six letters, there may be additional varying winning modes, depending on the number of letters and odds of winning, including winning modes enabling "jackpots." It is anticipated that draws will take place every 5 or so minutes, creating excitement for players who enjoy lottery games on a frequent basis.

Figure 1:
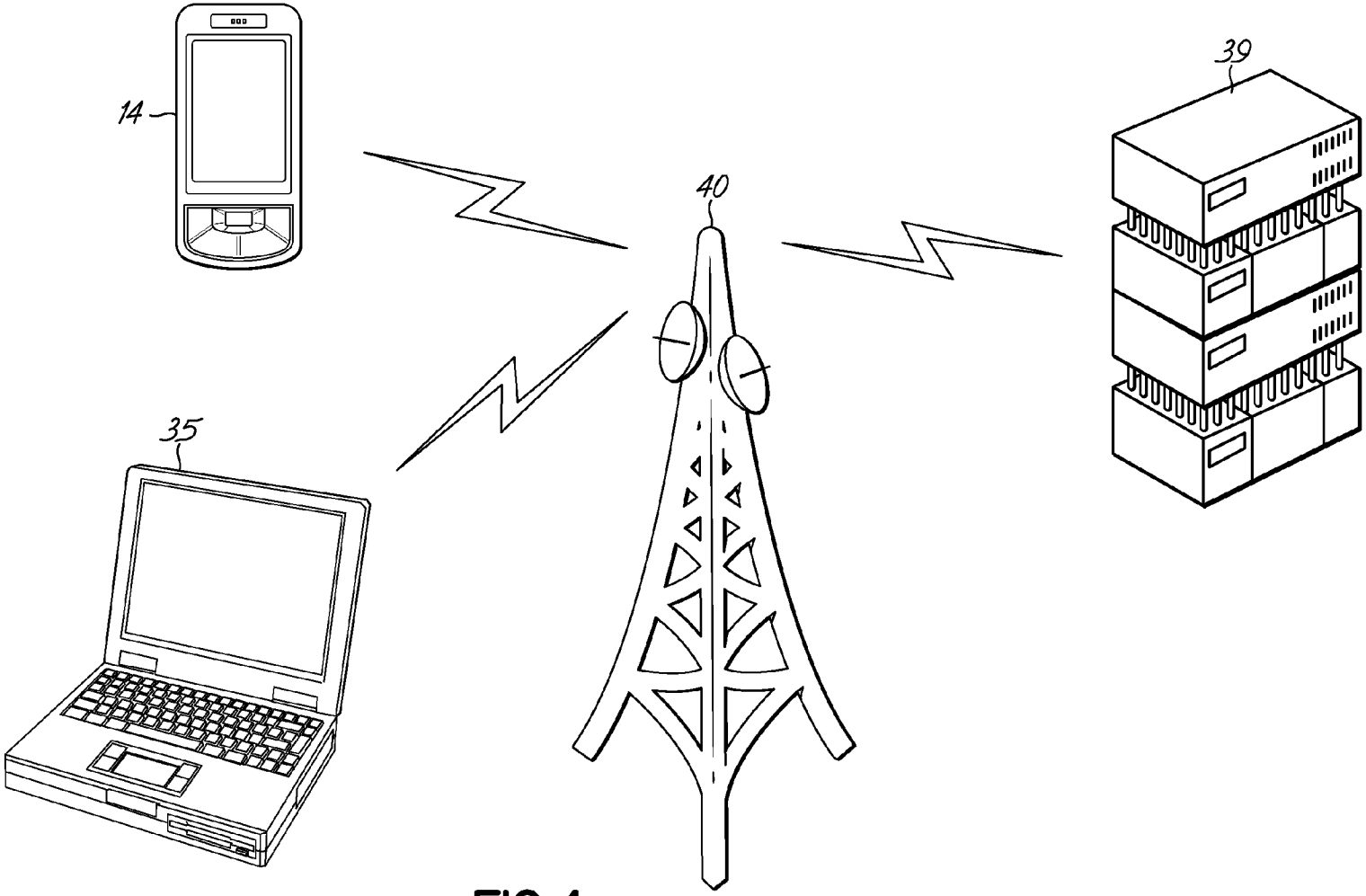
FIG. 1 is a graphic representation showing one mode of how a game according to one embodiment of this invention may be played via a variety of electronic devices.

After conducting the draw, the lottery system, in one embodiment, notifies the player via text message 34 on the player's mobile device 14 as to whether the player's word 16 satisfied the winning mode, or in other words, whether the player won or lost. Alternatively, the player may be notified via a point-of-sale lottery terminal 35, a personal computer connected to the internet, a public release or in another manner. As seen in the embodiment of FIG. 1, the player may use a variety of electronic devices to play the game. As stated, the player also may also be notified of the results in the game via the electronic devices 14, as seen in FIG. 4. Also as shown in FIG. 2, the player has the ability to input the word or game selection input on his or her mobile device 14. As seen in FIG. 3, once the player has entered their selections or word into the lottery system, the lottery system notifies 30 via text message that the player's word has been entered into the drawing. As seen in FIG. 4, the player is notified 34 of the game results, such as a win, or partial match with at least some of the letters of the winning group. Once notified as in FIG. 4, the player may collect their winnings 36 by presenting their mobile device 14 to the lottery authority or a retailer, for example, who will then issue the player the winnings. After winning or losing, the player may enter the selected word into the drawing multiple times 38, up to thirty consecutive times in various embodiments of this invention.

The various embodiments of this invention include a lottery game conducted entirely via a player's electronic device 14, such as a cell phone, smart phone, personal digital assistant (PDA) or other device, in communication with the lottery authority 39 or retailer via a cellular network 40, the internet, area network or the like as shown in FIG. 1. Alternatively, the player may be physically present at a lottery retailer, provide their selections to the retailer electronically, via a play slip, verbally or another mode of communication. After the retailer enters the player's selections, the player may receive confirmation of their entry in a number of ways, including an SMS text, email or other electronic communication, or a printed ticket. This invention includes these and other modes of communication to and between the player and lottery authority as well as combinations and variations thereof.

The Hangman style lottery game according to various embodiments of this invention provides many winning categories as players can choose to participate in one of the five different game types, creating exciting game options for players. The short amount of time in between draws, likely five minutes, adds to the excitement. The Hangman style lottery game of this invention is a fixed-odds game, meaning that the player knows in advance of the potential winnings. Tables 1-6 display the odds of matching certain amounts of randomly generated letters according to each game in one embodiment of this invention. These odds are assuming the gaming system randomly draws ten letters from the twenty-six letter alphabet, with no letters being placed back into the choosable pool after being chosen.

TABLE 1

Odds, 6 Letters

| Matched letters | Odds |
|---|---|
| 6 | 1:1,096.3 |
| 5 | 1:57.1 |
| 4 | 1:9.1 |
| 3 | 1:3.4 |
| 2 | 1:2.8 |
| 0 | 1:28.8 |

TABLE 2

Odds, 5 Letters

| Matched letters | Odds |
|---|---|
| 5 | 1:261.0 |
| 4 | 1:19.6 |
| 3 | 1:4.6 |
| 2 | 1:2.6 |
| 0 | 1:15.1 |

TABLE 3

Odds, 4 Letters

| Matched letters | Odds |
|---|---|
| 4 | 1:71.2 |
| 3 | 1:7.8 |
| 2 | 1:2.8 |
| 0 | 1:8.2 |

TABLE 4

Odds, 3 Letters

| Matched letters | Odds |
|---|---|
| 3 | 1:21.7 |
| 2 | 1:3.6 |
| 0 | 1:4.6 |

TABLE 5

Odds, 2 Letters

| Matched letters | Odds |
|---|---|
| 2 | 1:7.2 |
| 0 | 1:2.7 |

Tables 6-10 indicate the prize structure involved with each game, where the winning amount determined by multiplying the amount wagered by the number in the "times the stake" column.

TABLE 2

Prize Structure, Six Letters

| Matched letters | Times the stake |
|---|---|
| 6/6 | 600 |
| 5/6 | 6 |
| 4/6 | — |
| 3/6 | — |
| 2/6 | — |
| 1/6 | — |
| 0/6 | — |

TABLE 3

Prize Structure, Five Letters

| Matched letters | Times the stake |
|---|---|
| 5/5 | 200 |
| 4/5 | — |
| 3/5 | — |
| 2/5 | — |
| 1/5 | — |
| 0/5 | — |

TABLE 4

Prize Structure, Four Letters

| Matched letters | Times the stake |
|---|---|
| 4/4 | 60 |
| 3/4 | — |
| 2/4 | — |
| 1/4 | — |
| 0/4 | — |

TABLE 5

Prize Structure, Three Letters

| Matched letters | Times the stake |
|---|---|
| 3/3 | 20 |
| 2/3 | — |
| 1/3 | — |
| 0/3 | — |

TABLE 6

Prize Structure, Two letters

| Matched letters | Times the stake |
|---|---|
| 2/2 | 6 |
| 1/2 | — |
| 0/2 | — |

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

I claim:

1. A method for conducting a lottery game, comprising the steps of:

receiving an input from a player of a selected word, comprising a plurality of letters;

receiving play information from the player;

defining a pool of letters with a processor, the pool of letters comprising an alphabet from which a winning group of letters is drawn, wherein each letter of the alphabet has an equal probability of being drawn with the winning group and can be drawn only once;

drawing the winning group from the pool of letters with the processor, wherein the winning group includes at least as many letters as the selected word;

comparing the selected word with the winning group with the processor;

defining a winning mode with the processor, wherein a predetermined amount of letters in the winning group coincide with the letters comprising the selected word; and indicating to the player whether the selected word satisfies the winning mode.

2. The method of claim 1 wherein the receiving play information step further comprises receiving from the player an amount of wager desired by the player, and an amount of draws to be played using the selected word.

3. The method of claim 1, further comprising:

defining a plurality of at least five games playable by the player.

4. The method of claim 3 further comprising:

defining a first game when the selected word includes two letters;

defining a second game when the selected word includes three letters;

defining a third game when the selected word includes four letters;

defining a fourth game when the selected word includes five letters; and defining a fifth game when the selected word includes six letters.

5. The method of claim 4, wherein the defining the winning mode step further comprises:

defining the winning group for the first game to include the two letters of the selected word;

defining the winning group for the second game to include the three letters of the selected word;

defining the winning group for the third game to include the four letters of the selected word;

defining the winning group for the fourth game to include the five letters of the selected word; and defining the winning group for the fifth game to include five or six letters of the selected word.

6. The method of claim 1 further comprising:

the player inputting the selected word or prompting the lottery system to randomly generate the selected word using one of the following input devices adapted to communicate with a lottery system: a mobile device, a point-of-sale lottery terminal and a computer.

7. The method of claim 1, wherein:

the winning group includes ten letters; and the selected word comprises between two and six letters.

8. The method of claim 1, wherein the indicating step further comprises sending an electronic communication to the player via a communication device.

9. The method of claim 8, wherein the communication device is one of the following: a mobile device, a point-of-sale lottery terminal and a computer.

10. A method for conducting a lottery game, comprising the steps of:

receiving an input from a player of a selected word, comprising a plurality of letters;

receiving play information from the player;

defining a plurality of pools of letters, each pool of letters comprising an alphabet from which a winning group of letters is drawn, wherein each letter of the alphabet has an equal probability of being drawn with the winning group and can be drawn only once;

drawing at least one letter of the winning group from a first pool and at least one letter from a separate pool;

comparing the selected word with the winning group with a processor;

defining a winning mode with the processor, wherein a predetermined amount of letters in the winning group coincide with the letters comprising the selected word; and indicating to the player whether the selected word satisfies the winning mode.

11. A method for conducting a lottery game, comprising the steps of:

receiving an input from a player of a selected word, comprising a plurality of letters;

receiving play information from the player;

defining a plurality of pools of letters, each pool of letters comprising an alphabet from which a winning group of letters is drawn, wherein each letter of the alphabet has an equal probability of being drawn with the winning group and can be drawn only once;

drawing each letter of the winning group from a separate pool;

comparing the selected word with the winning group with a processor;

defining a winning mode with the processor, wherein a predetermined amount of letters in the winning group coincide with the letters comprising the selected word; and indicating to the player whether the selected word satisfies the winning mode.

12. A method of conducting a lottery game, comprising the steps of:

defining a plurality of words with a processor, the words including at least two letters able to be input by a player into a lottery system;

receiving a selected word as input from the player, wherein the player inputs the selected word by entering the selected word into a communication device adapted to communicate with a lottery system;

receiving play information, including an amount of wager desired by the player and an amount of draws to be played using the selected word;

defining a pool of letters with the processor, the pool comprising the alphabet from which a winning group of letters is drawn, wherein each letter of the alphabet has an equal probability of being drawn with the winning group and can be drawn only once;

drawing the winning group of letters from the pool of letters with the processor, wherein the winning group includes at least as many letters as the selected word;

with the processor, defining a winning mode with a predetermined amount of letters in the winning group coinciding with the letters comprising the selected word; and indicating to the player via the communication device with the processor whether the selected word satisfies the winning mode.

13. The method of claim 12 wherein the receiving a selected word step is preceded by the player requesting the lottery system to provide the selected word to the player and the player then later confirming their use of the selected word.

14. A method of conducting a lottery game comprising the steps of:

receiving a selected symbol combination from a player;

receiving play information from a player;

defining a pool of symbols from which a winning group of symbols is selected with a processor, wherein each symbol from the pool has an equal probability of being drawn with the winning group and can be drawn only once;

selecting the winning group of symbols, wherein the winning group has no more members than the pool of symbols with the processor;

defining a winning criteria with the processor;

comparing the selected symbol combination with the winning group of members according to the winning criteria with the processor; and indicating to the player an outcome of the comparing step.

15. The method of claim 14 wherein the selected symbol combination is a word and the pool of symbols is an alphabet.

16. The method of claim 14 wherein the receiving play information step further comprises receiving at least one of a wager amount, a number of draws in which to enter the selected symbol combination and a multiplier.

17. The method of claim 14 wherein the receiving steps and the indicating steps are accomplished electronically via a player's electronic device.

* * * * *